US010988848B2

(12) United States Patent
Kawanishi et al.

(10) Patent No.: US 10,988,848 B2
(45) Date of Patent: Apr. 27, 2021

(54) ELECTROLYTIC CELL INCLUDING ELASTIC MEMBER

(71) Applicant: THYSSENKRUPP UHDE CHLORINE ENGINEERS GMBH, Dortmund (DE)

(72) Inventors: Koji Kawanishi, Tokyo (JP); Takehiro Oiwa, Tokyo (JP); Shinichiro Yamamoto, Tokyo (JP); Masaki Watanabe, Okayama (JP)

(73) Assignee: THYSSENKRUPP UHDE CHLORINE ENGINEERS GMBH, Dortmund (DE)

( * ) Notice: Subject to any disclaimer, the term of this patent is extended or adjusted under 35 U.S.C. 154(b) by 132 days.

(21) Appl. No.: 16/307,089

(22) PCT Filed: Jun. 13, 2017

(86) PCT No.: PCT/JP2017/021864
§ 371 (c)(1),
(2) Date: Dec. 4, 2018

(87) PCT Pub. No.: WO2017/217427
PCT Pub. Date: Dec. 21, 2017

(65) Prior Publication Data

US 2019/0226100 A1 Jul. 25, 2019

(30) Foreign Application Priority Data

Jun. 14, 2016 (JP) ..... JP2016-118157

(51) Int. Cl.
*C25B 9/19* (2021.01)
*C25B 1/46* (2006.01)
(Continued)

(52) U.S. Cl.
CPC ..... *C25B 9/19* (2021.01); *C25B 1/46* (2013.01); *C25B 9/63* (2021.01); *C25B 9/65* (2021.01)

(58) Field of Classification Search
CPC .... C25B 9/08; C25B 1/10; C25B 9/00; C25B 9/06; C25B 9/02
(Continued)

(56) References Cited

U.S. PATENT DOCUMENTS

| | | | |
|---|---|---|---|
| 5,360,526 | A | 11/1994 | Arimoto |
| 2003/0155232 | A1 | 8/2003 | Katayama |
| 2003/0188966 | A1 | 10/2003 | Katayama |
| 2007/0235338 | A1 | 10/2007 | Kodama |

(Continued)

FOREIGN PATENT DOCUMENTS

| | | | |
|---|---|---|---|
| CN | 1442512 | A | 9/2003 |
| CN | 101074481 | A | 11/2007 |

(Continued)

OTHER PUBLICATIONS

International Search Report issued in PCT/JP2017/021864, dated Aug. 24, 2017.

*Primary Examiner* — Zulmariam Mendez
(74) *Attorney, Agent, or Firm* — thyssenkrupp North America, LLC

(57) ABSTRACT

An electrolytic cell that prevents, or at least minimizes, damage to a membrane and reduces electrolytic voltage may include an elastic member attached to an electrolytic partition wall within an anode chamber and/or a cathode chamber. The elastic member comprises a spring retaining part and a bonding part that is bonded to the electrolytic partition wall, parallel first support parts extending from the bonding part away from the electrolytic partition wall, a second support part connecting the first support parts, and two parallel spring rows. Each spring row may include first flat spring-like bodies, which originate from the first support
(Continued)

part and extend toward the opposite direction of the electrolytic partition wall, and second flat spring-like bodies, which originate from the second support part and extend toward the opposite direction of the electrolytic partition wall.

17 Claims, 3 Drawing Sheets

(51) Int. Cl.
*C25B 9/63* (2021.01)
*C25B 9/65* (2021.01)

(58) Field of Classification Search
USPC ..... 204/252
See application file for complete search history.

(56) References Cited

U.S. PATENT DOCUMENTS

| | | | |
|---|---|---|---|
| 2007/0278095 | A1 | 12/2007 | Asaumi |
| 2008/0053821 | A1 | 3/2008 | Suzuki |
| 2009/0050472 | A1 | 2/2009 | Federico |
| 2015/0114830 | A1 | 4/2015 | Asaumi |
| 2016/0060771 | A1 | 3/2016 | Haryu |

FOREIGN PATENT DOCUMENTS

| | | | |
|---|---|---|---|
| CN | 202072770 | U | 12/2011 |
| CN | 104254644 | A | 12/2014 |
| EP | 1 378 589 | A | 1/2004 |
| JP | 2004-2993 | A | 1/2004 |
| JP | 2008063611 | A | 3/2008 |
| JP | 2015117407 | A | 6/2015 |
| JP | 2016047946 | A | 4/2016 |
| WO | 2015/068579 | A | 5/2015 |

[Fig. 1]
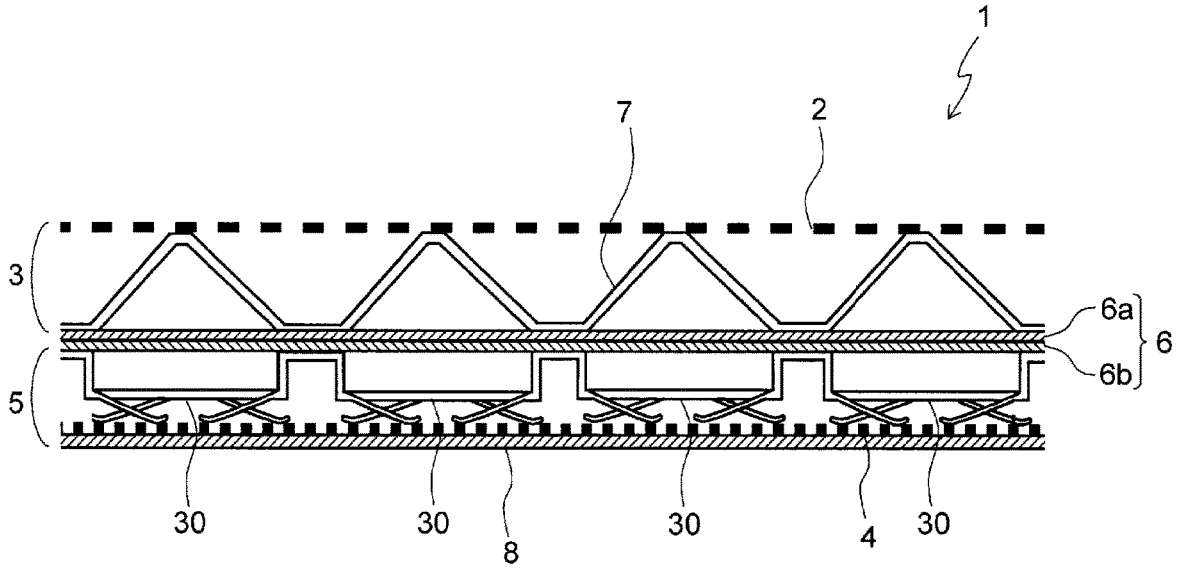
[Fig. 2]
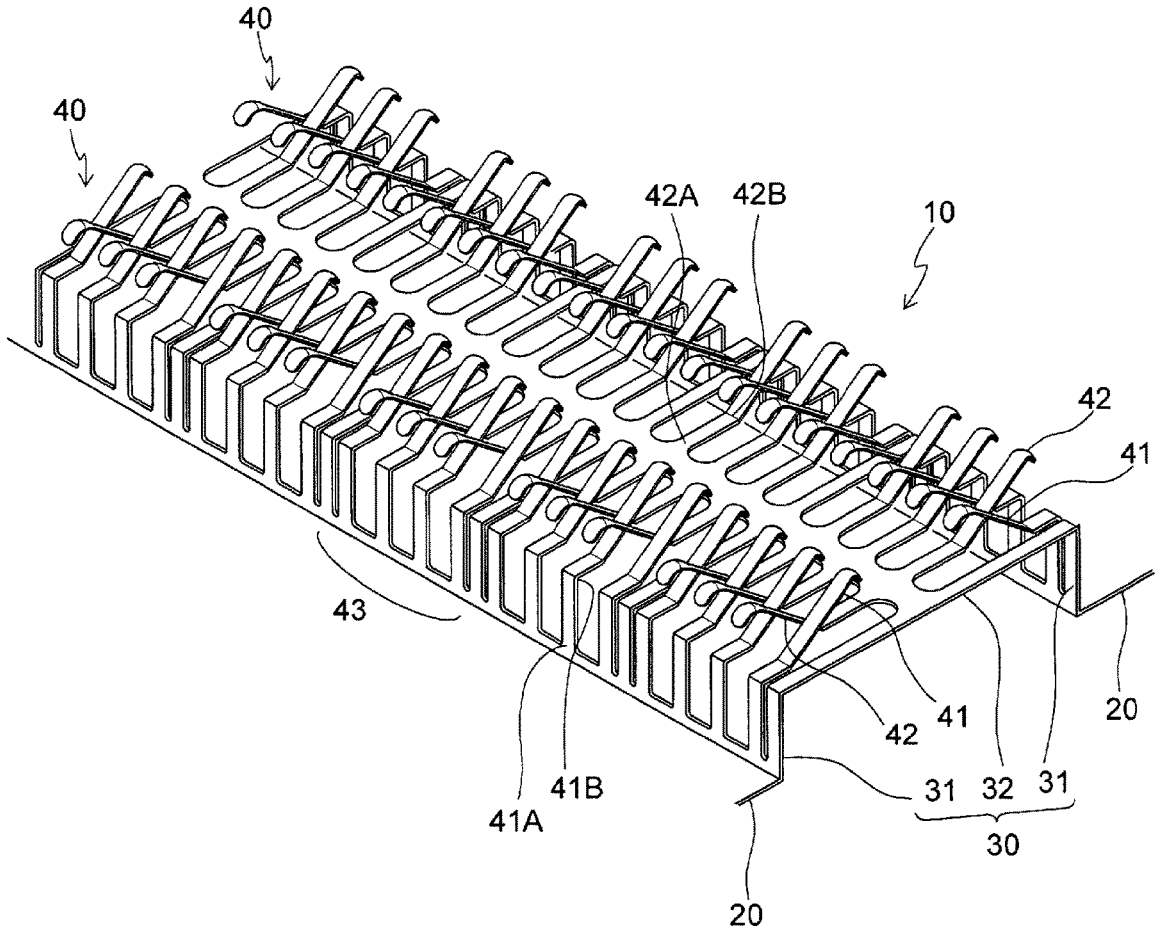

[Fig. 3]
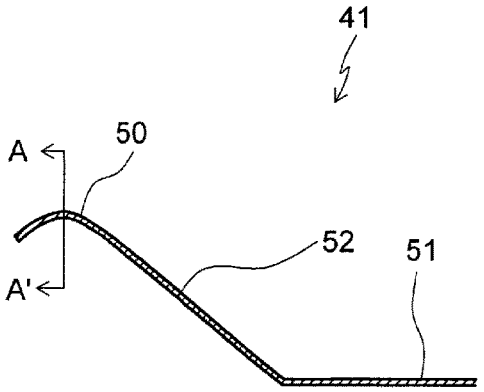
[Fig. 4]
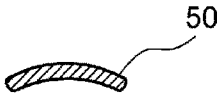
[Fig. 5]
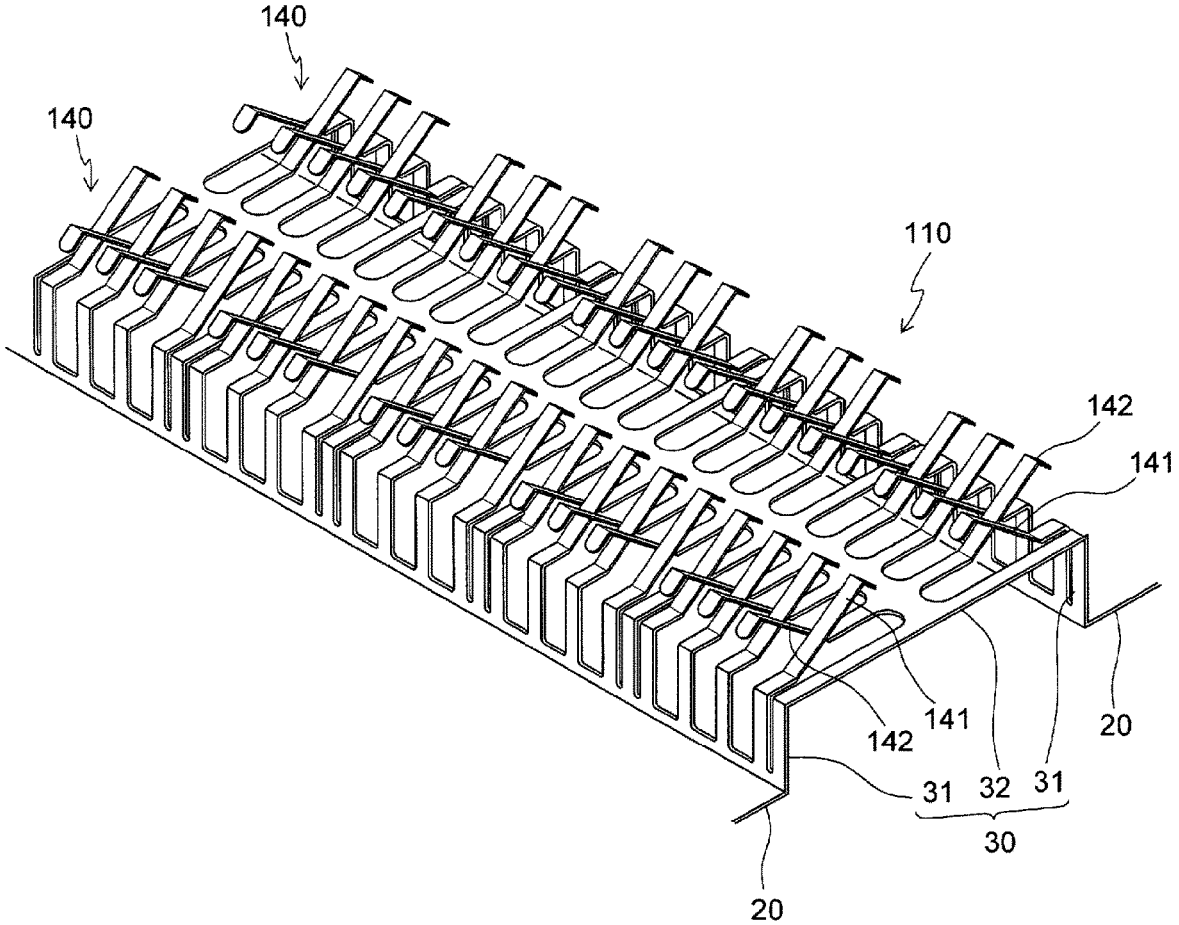

[Fig. 6]
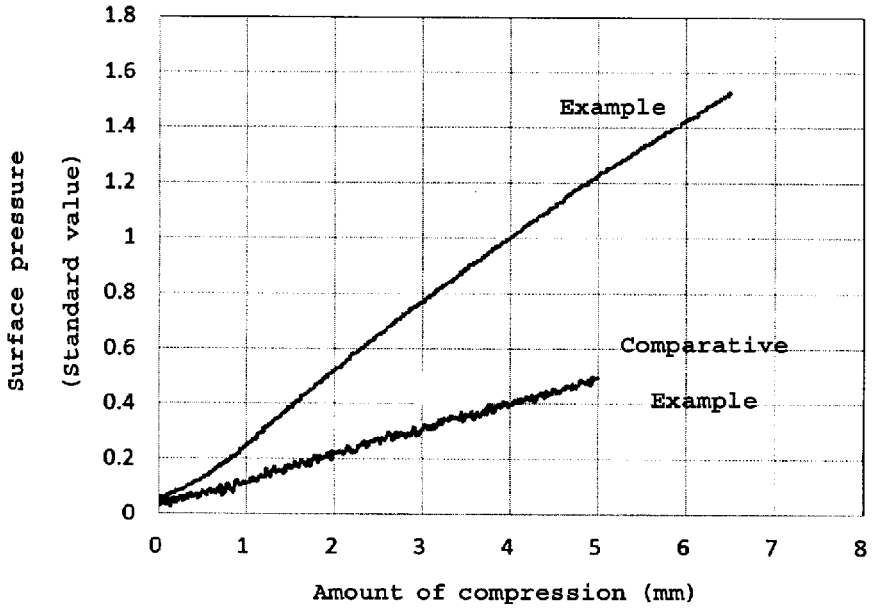
[Fig. 7]
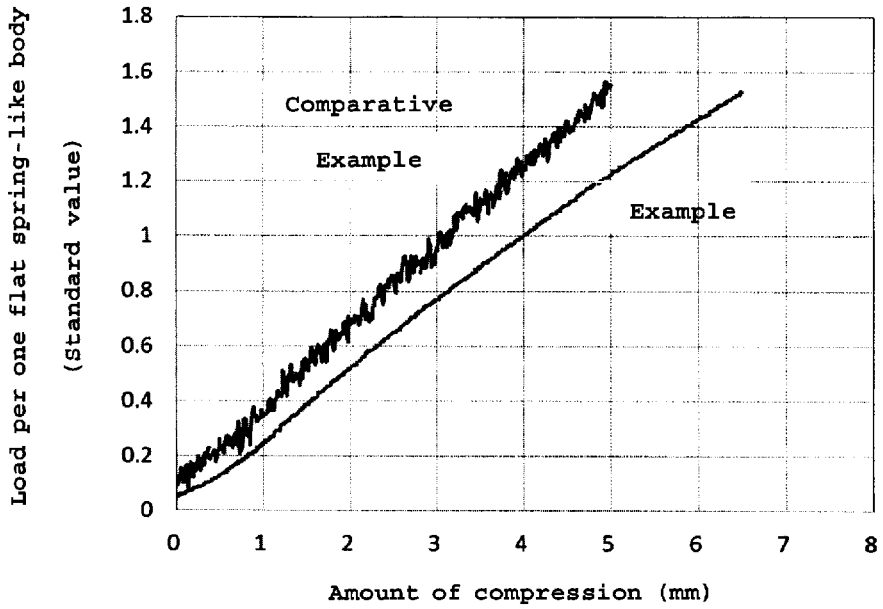

ELECTROLYTIC CELL INCLUDING ELASTIC MEMBER

CROSS REFERENCE TO RELATED APPLICATIONS

This application is a U.S. National Stage Entry of International Patent Application No. PCT/JP2017/021864, filed Jun. 13, 2017, which claims priority to Japanese Patent Application No. JP 2016-118157, filed Jun. 14, 2016, the entire contents of both of which are incorporated herein by reference.

FIELD

The present disclosure generally relates to electrolytic cells, including electrolytic cells with elastic members that cause little damage to membranes.

BACKGROUND

In an electrolytic cell used in electrolysis of an aqueous solution, the voltage necessary for electrolysis is influenced by various factors. Among such factors, the interval between the anode and the cathode greatly affects the electrolytic cell voltage. Thus, the amount of energy consumption required for electrolysis is reduced by decreasing the interval between the electrodes to decrease the electrolytic cell voltage. In an ion-exchange membrane electrolytic cell or the like used in electrolysis of a salt solution, the anode, ion-exchange membrane, and the cathode are arranged in a closely fitted state so as to reduce the electrolytic cell voltage. However, in a large electrolytic cell in which the electrode surface area may reach several square meters, in the case that the anode and the cathode are bonded to the electrode chambers by a rigid member, it has been difficult to closely fit the electrodes to the ion-exchange membrane and decrease the electrode interval to retain it at a prescribed value without applying excessive pressure to the ion-exchange membrane.

In order to overcome such problems, an electrolytic cell has been proposed in which a flexible electrode is used for at least one of the anode and the cathode so that the interval between the electrodes is adjustable.

Japanese Patent Publication No. JP 2004-2993 A proposes providing an elastic member and a flexible electrode in at least one of the electrode chambers. The elastic member has a structure including a support member disposed on an electrolytic partition wall and a plurality of pairs of comb-like flat spring-like bodies extending in an inclined manner from the support member, and the comb-like flat spring-like bodies of each pair are inserted so the adjacent flat spring-like bodies mutually oppose each other. By installing the above-described elastic body, the electrode surface can be kept smooth even when using an electrode with a large surface area, and damage to the ion-exchange membrane due to positional deviation of the electrode and excessive pressure applied to the surface of the ion-exchange membrane can be reduced.

However, even in the ion-exchange membrane electrolytic cell proposed in Japanese Patent Publication No. JP 2004-2993 A, it was difficult to completely prevent damage to the ion-exchange membrane. Further, due to the shape of the electrode, there were cases in which the voltage rose when the electrode was combined with the elastic member of Japanese Patent Publication No. JP 2004-2993 A. In addition, further reductions in the electrolytic voltage were desired in order to reduce the operational costs.

Thus a need exists for an electrolytic cell that prevents, or at least minimizes, damage to a membrane such as an ion-exchange membrane or a diaphragm and that can reduce the electrolytic voltage compared to conventional electrolytic cells.

BRIEF DESCRIPTION OF THE FIGURES

FIG. 1 is a schematic cross-sectional view of an example electrolytic cell unit.

FIG. 2 is an enlarged schematic perspective view of an example elastic member.

FIG. 3 is a schematic longitudinal cross-sectional view of an example flat spring-like body of an elastic member.

FIG. 4 is a cross-sectional view along line A-A' in FIG. 3 of the flat spring-like body of the elastic member.

FIG. 5 is an enlarged schematic perspective view of another example elastic member.

FIG. 6 is a graph illustrating a relationship between an amount of compression of flat spring-like bodies and contact surface pressure in an example and a comparative example.

FIG. 7 is a graph illustrating a relationship between an amount of compression of flat spring-like bodies and load per one flat spring-like body in an example and a comparative example.

DETAILED DESCRIPTION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

In some examples, an elastic member may be provided on an electrolytic partition wall of the electrolytic cell with a prescribed structure.

In some examples, an electrolytic cell may include an anode chamber accommodating an anode; a cathode chamber accommodating a cathode; an electrolytic partition wall that partitions the anode chamber and the cathode chamber; and an elastic member attached to the electrolytic partition wall within at least one of the anode chamber and the cathode chamber. The elastic member may have a spring retaining part including a bonding part that is bonded to the electrolytic partition wall; a pair of first support parts that extend from the bonding part in an opposite direction of the electrolytic partition wall, and that are arranged parallel to each other; a second support part that connects the ends of the pair of first support parts to each other; and two spring rows extending in a direction parallel to a parallel arrangement direction of the pair of first support parts. Each spring row may be formed by combining a plurality of first flat spring-like bodies which originate from the first support part as a starting point and extend toward the opposite direction of the electrolytic partition wall, and a plurality of second flat spring-like bodies which originate from the second support part as a starting point and extend toward the opposite direction of the electrolytic partition wall.

Each first flat spring-like body is preferably bent toward the other first support part of the pair of first support parts at a position which is the same distance as that from the bonding part to a connecting part of the first support part and the second support part. Furthermore, each first flat spring-like body preferably extends parallel to a direction in which the first support parts extend in the opposite direction of the electrolytic partition wall to a position which is the same distance as that from the bonding part to the connecting part of the first support part and the second support part, and then is preferably bent toward the other first support part of the pair of first support parts at a position which is the same distance as that from the bonding part to the connecting part.

Each spring row preferably includes a spring unit in which the plurality of the first flat spring-like bodies and the plurality of second flat spring-like bodies are arranged alternately.

Distal ends of the first flat spring-like bodies and distal ends of the second flat spring-like bodies preferably form a bent shape which is convex toward the opposite direction of the electrolytic partition wall in a longitudinal direction cross-section view.

Distal ends of the first flat spring-like bodies and distal ends of the second flat spring-like bodies preferably form a bent shape which is convex toward the opposite direction of the electrolytic partition wall in a cross-section view of a plane that is orthogonal to the longitudinal direction.

The example electrolytic cells of the present disclosure cause little damage to a membrane such as an ion-exchange membrane or a diaphragm and simultaneously can suppress the damage of the electrodes compared to conventional electrolytic cells. Further, the surface pressure can be appropriately adjusted by the above-described elastic member, and thus the electrolytic voltage can be reduced.

FIG. 1 is a schematic cross-section view of an electrolytic cell unit applied to an electrolytic cell of a suitable embodiment of the present invention. An electrolytic cell unit 1 illustrated therein is a bipolar-type electrolytic cell unit provided with an anode chamber 3, a cathode chamber 5, and an electrolytic partition wall 6 that partitions the anode chamber 3 and the cathode chamber 5. In FIG. 1, the electrolytic partition wall 6 is configured by combining an anode partition wall 6*a* and a cathode partition wall 6*b*. However, the present embodiment is also applicable in a case in which there is a single electrolytic partition wall. An anode 2 is accommodated within the anode chamber 3 opposing the electrolytic partition wall 6. A cathode 4 is accommodated within the cathode chamber 5 opposing the electrolytic partition wall 6.

The form of the anode 2 and the cathode 4 is not particularly limited. For example, expanded metal, a net-like body, and a woven body can be used. As the cathode 4, a cathode in which an electrode catalytic substance such as a platinum group metal-containing layer, a Raney nickel-containing layer, or an activated carbon-containing nickel layer is coated onto the surface of a substrate made of nickel or nickel alloy of the above-mentioned forms may be used. As the anode 2, an anode constituted by coating an electrode catalytic substance containing a platinum group metal or an oxide of a platinum group metal onto the surface of a substrate of the above-mentioned forms which is made of a thin-film-forming metal such as titanium, tantalum, or zirconium or an alloy thereof may be used.

In the electrolytic cell unit 1, an anode retaining member 7 is disposed within the anode chamber 3. The anode retaining member 7 is bonded by welding to the anode 2 and the electrolytic partition wall 6. Thereby, the anode 2 and the electrolytic partition wall 6 are electrically connected via the anode retaining member 7.

In the electrolytic cell unit 1, an elastic member 10 is disposed within the cathode chamber 5. The elastic member 10 is constituted by a plurality of spring retaining parts 30 and two spring rows 40 provided on each spring retaining part 30. The elastic member 10 contacts the electrolytic partition wall 6. The spring rows 40 contact the cathode 3. Thereby, the cathode 3 and the electrolytic partition wall 6 are electrically connected via the elastic member 10.

The electrolytic cell of a suitable embodiment of the present invention is assembled for use by laminating a plurality of the electrolytic cell units 1 via a membrane 8 such as an ion-exchange membrane or diaphragm.

FIG. 1 illustrates an example in which the elastic member 10 is disposed within the cathode chamber 5, but the elastic member 10 may also be disposed within the anode chamber 3.

FIG. 2 is an enlarged schematic perspective view of an elastic member according to the electrolytic cell of the present invention. The elastic member 10 is constituted by a bonding part 20 and the spring retaining part 30. The spring retaining part 30 includes a pair of first support parts 31 and a second support part 32. The bonding part 20 is bonded to the flat panel-shaped electrolytic partition wall 6. The first support parts 31 are members that extend from the bonding part 20 toward the opposite direction of the electrolytic partition wall 6. The pair of first support parts 31 are disposed parallel to each other in the plane of the electrode partition wall 6. The second support part 32 connects the ends of the pair of first support parts 31 on the opposite side of the electrolytic partition wall 6 to each other. The spring retaining part 30 is constituted by combining the first support parts 31 and the second support part 32.

In the example of FIGS. 1 and 2, the first support parts 31 are disposed to extend in a direction orthogonal to the electrode partition wall 6, but the present embodiment is not limited to this constitution. One of the first support parts 31 may be disposed at an incline relative to the other first support part 31. In this case, both of the first support parts 31 may be inclined, or only one of the first support parts 31 may be inclined. Further, in the example of FIGS. 1 and 2, the ends of the first support parts 31 are positioned at the same distance from the electrolytic partition wall 6, and the second support part 32 is approximately parallel to the electrolytic partition wall 6. However, the present embodiment is not limited to this constitution. The ends of the first support parts 31 may be positioned at different distances from the electrolytic partition wall 6 so that the second support part 32 is inclined relative to the electrolytic partition wall 6.

Each spring retaining part 30 has two spring rows 40. The spring rows 40 extend in the direction in which the pair of first support parts 31 are disposed parallel to each other. In other words, the spring rows 40 extend in a direction orthogonal to the direction in which the plurality of spring retaining parts 30 are arranged within the elastic member 10.

One spring row 40 is constituted by combining a plurality of first flat spring-like bodies 41 and a plurality of second flat spring-like bodies 42. The first flat spring-like bodies 41 and the second flat spring-like bodies 42 are arranged in a comb-like fashion in the direction in which the pair of first support parts 31 are disposed parallel to each other, i.e. in the direction orthogonal to the direction in which the plurality of spring retaining parts 30 are arranged. Within one spring row 40, a row of the first flat spring-like bodies 41 and a row of the second flat spring-like bodies 42 are parallel to each other.

The first flat spring-like bodies 41 originate from the first support part 31 as a starting point and extend toward the opposite direction of the electrolytic partition wall 6. In other words, the first flat spring-like bodies 41 extend toward the cathode. The first flat spring-like bodies 41 originate from the inside of the first support part 31 as a starting point 41A, and are bent toward the other first support part 31 (in other words, in the direction of the second flat spring-like bodies 42 within the same spring row 40) at a position (hereinafter referred to as the "bending point 41B") which is the same distance as that from the bonding part 20 to a connecting part of the first support part 31 and the second support part 32. In the example of FIG. 2, the first flat spring-like bodies 41 extend parallel to the direction in which the first support part 31 extends in the opposite direction of the electrolytic partition wall 6 from the starting point 41A within the first support part 31 to the bending point 41B, and then bend in an in-plane direction of the second support part 32 at the position corresponding to the bending point 41B. Further, the ends of the first flat spring-like bodies 41 are bent in the opposite direction of the electrolytic partition wall 6 (toward the cathode in the illustrated example) as described above in the plane of the second support part 32. In the case of the present embodiment, the starting point of the first flat spring-like bodies 41 may be at the border between the first support part 31 and the bonding part 20. The length of the first flat spring-like bodies 41 can be changed by changing the position of the starting point.

The second flat spring-like bodies 42 originate from the second support part 32 as a starting point and extend toward the opposite direction of the electrolytic partition wall 6. In other words, the second flat spring-like bodies 42 extend toward the cathode. In the example of FIG. 2, the second flat spring-like bodies 42 extend from a starting point 42A approximately parallel to the second support member 32 toward the row of first flat spring-like bodies 41 which forms the pair within the same spring row 40, and then are bent toward the opposite direction of the electrolytic partition wall 6 at a bending point 42B which is at an intermediate position. The second flat spring-like bodies 42 may have a shape in which they are bent from the starting point 42A toward the opposite direction of the electrolytic partition wall 6.

The elastic modulus of the first flat spring-like bodies 41 can be changed by changing the overall length, length of the inclined portion, amount of bending, etc. of the first flat spring-like bodies 41. The elastic modulus of the second flat spring-like bodies 42 can be changed by the overall length, amount of bending, etc. of the second flat spring-like bodies 42. The dimensions of the first flat spring-like bodies 41 and the second flat spring-like bodies 42 can be appropriately designed in consideration of the surface pressure from the elastic member 10 pressing on the electrode (the cathode in the illustrated example). In the present embodiment, the first flat spring-like bodies 41 are preferably longer than the second flat spring-like bodies 42.

In the present embodiment, the first flat spring-like bodies 41 and the second flat spring-like bodies 42 are arranged alternately in at least a portion within the spring row 40. In the example of FIG. 2, the first flat spring-like bodies 41 and the second flat spring-like bodies 42 are arranged alternately in a spring group 43 illustrated therein. With this spring group 43 as a single unit, one spring row 40 is constituted by aligning a plurality of spring groups 43. Therefore, the first flat spring-like bodies 41 are continuous between adjacent spring groups 43.

As an alternative example, the second flat spring-like bodies 42 may be continuous between adjacent spring groups 43, or the first flat spring-like bodies 41 and the second flat spring-like bodies 42 may be arranged alternately over the entirety of the spring row 40.

In the example of FIG. 2, the ratio of the numbers of the first flat spring-like bodies 41 and the second flat spring-like bodies 42 within one spring group 43 is 4:3. However, this ratio may be appropriately set in consideration of the surface pressure from the elastic member 10 pressing on the electrode (the cathode in the illustrated example).

In FIG. 2, the first flat spring-like bodies 41 and the second flat spring-like bodies 42 within one spring row 40 are configured such that their ends are inserted into each other. Thereby, as shown in FIGS. 1 and 2, when viewed from the direction in which the first support parts 31 extend (the direction orthogonal to the arrangement direction of the spring support parts 30), the ends of the first flat spring-like bodies 41 and the ends of the second flat spring-like bodies 42 cross each other. However, the present embodiment is not limited to this constitution, and the ends of the flat spring-like bodies do not have to cross each other.

Since the length and shape of the first flat spring-like bodies differ from those of the second flat spring-like bodies, they each have a different elastic modulus. By changing the dimensions of the spring-like bodies, the ratio of the numbers of the first flat spring-like bodies and the second flat spring-like bodies, etc., the elastic modulus of the elastic member as a whole can be changed. Therefore, it is possible to control to a desired surface pressure.

For example, the number of contact points with the electrode (the cathode 4 in the illustrated example) can be increased by providing two spring rows on a single spring retaining part. As a result, compared to the conventional elastic member disclosed in Patent Literature 1, the load applied per each flat spring-like body can be reduced even though the surface area of the elastic member is the same.

Given the above, the elastic member of the present embodiment can suppress the application of excessive pressure on the membrane, and can suppress damage to the electrode itself. Further, by appropriately controlling the surface pressure, the electrolytic voltage can be reduced.

Further, in order to lower the electrolytic voltage, it is preferable to uniformly press the anode and the cathode to the membrane and retain both electrodes so that they are closely fitted to the membrane. In order to make the pressure on the electrodes uniform, it is necessary to increase the number of spring-like bodies. The elastic member of the present embodiment can also reduce the operation costs of the electrolytic cell because both electrodes can be more uniformly fitted to the membrane compared to Patent Literature 1. In addition, the elastic member of the present embodiment can increase the number of spring-like bodies without requiring any complicated machining, and thus is also advantageous in terms of manufacturing costs compared to the elastic member of Patent Literature 1.

FIG. 3 is a schematic cross-section view in a longitudinal direction of a first flat spring-like body showing the distal end portion of the first flat-spring shaped body of FIG. 2. As shown in FIG. 3, in the longitudinal direction cross-section view (the direction in which the first support parts 31 extend in the plane of the electrolytic partition wall 6), a distal end portion 50 of the first flat spring-like body 41 has a bent shape which is convex toward the opposite direction (the cathode) of the electrolytic partition wall 6. In FIG. 3, the bent shape is an arc.

FIG. 4 is a schematic cross-section view along A-A' in FIG. 3. As shown in FIG. 4, the distal end portion 50 of the first flat spring-like body 41 has a bent shape in which the cross-section orthogonal to the longitudinal direction of the first flat spring-like body 41 is convex toward the opposite direction (the cathode) of the electrolytic partition wall 6. In FIG. 4, the bent shape is an arc shape.

As is clear from FIG. 2, the distal end portion of each second flat spring-like body 42 also has the same shape as the first flat spring-like bodies 41.

In the present embodiment, the distal end portions of both of the flat spring-like bodies may be bent in only the longitudinal direction, and the cross-section orthogonal to the longitudinal direction may be flat.

FIG. 5 is an enlarged schematic perspective view explaining another example of the elastic member according to the electrolytic cell of the present invention. The same reference signs are assigned to those constitutions which are identical to FIG. 2. An elastic member 110 of FIG. 5 differs from the elastic member 10 of FIG. 2 with regard to the shapes of the distal end portions of first flat spring-like bodies 141 and the distal end portions of second flat spring-like bodies 142 of spring rows 140. In the elastic member 110 illustrated in FIG. 5, the distal end portions of the first flat spring-like bodies 141 and the distal end portions of the second flat spring-like bodies 142 have a bent shape in which the bent portion has a corner in the longitudinal direction cross-section view. Further, the cross-section orthogonal to the longitudinal direction is not bent and is flat.

By bending the distal ends of the first flat spring-like bodies 41 and the second flat spring-like bodies 42 as shown in FIGS. 2 to 4, the contact surface area is decreased when the cathode is pressed to the elastic member 10, and thus damage to the cathode can be reduced. In particular, since the cross-section orthogonal to the longitudinal direction also has a bent shape as shown in FIG. 4, the contact surface area can be decreased even further and this is advantageous. However, the contact surface area between the cathode and the elastic member 110 can also be decreased even with the shape shown in FIG. 5. The shape of FIG. 5 is advantageous in that the machining of the first flat spring-like bodies 141 and the second flat spring-like bodies 142 is easy.

In the electrolytic cell of the present embodiment, the sizes of the elastic member 10 and the first flat spring-like bodies 41 and the second flat spring-like bodies 42 can be determined according to the electrode surface area of the electrolytic cell, etc. The elastic member 10 can be produced by, for example, punching a metal sheet having a thickness of 0.1 mm to 0.5 mm and then continuously bending with a press-molding machine, etc. The size of the first flat spring-like bodies 41 and the second flat spring-like bodies 42 is, for example, 1 mm to 10 mm wide and 20 mm to 50 mm long.

In the above example, only two spring rows are aligned. However, the shape of the elastic member of the present embodiment is not limited thereto. For example, in between the two spring rows 40, a separate spring row in which two rows of the second flat spring-like bodies are arranged opposing each other may be formed.

In the above-described embodiment, a bipolar-type electrolytic cell unit was used. However, the elastic member explained in the present embodiment may be applied to a monopolar-type electrolytic cell.

In the above-described embodiment, the elastic member was provided in the cathode chamber 5, but the elastic member may also be provided in the anode chamber 3.

If the elastic member is provided in the cathode chamber 5, the elastic member is made of a material exhibiting good corrosion resistance in the environment within the cathode chamber 5. Specifically, for the material of the elastic member, nickel, nickel alloy, stainless steel, etc. may be used.

If the elastic member is provided in the anode chamber 3, a thin-film-forming metal such as titanium, tantalum, or zirconium or an alloy thereof may be used for the material of the elastic member.

In the case that the electrolytic cell of the present embodiment is used for electrolysis of an aqueous solution of an alkali metal halide, e.g. electrolysis of a salt solution, a saturated salt solution is supplied to the anode chamber 3, water or a weak sodium hydroxide aqueous solution is supplied to the cathode chamber 5, electrolysis is carried out at a predetermined decomposition rate, and then the solution after electrolysis is removed from the electrolytic cell. In electrolysis of a salt solution using an ion-exchange membrane electrolytic cell, the electrolysis is carried out in a state in which the pressure of the cathode chamber 5 is retained higher than the pressure of the anode chamber 3 so that the membrane 8 is closely fitted to the anode 2. In the present embodiment, the cathode 4 is retained by the elastic member 10, and thus the electrolysis can be carried out with the cathode 4 positioned close to the surface of the membrane 8 by a predetermined distance. Further, the elastic member 10 according to the present embodiment has a large restoring force, and thus even if the pressure on the anode chamber 3 side has increased during an abnormality, operation in which the predetermined interval is maintained after the pressure has been removed is possible.

EXAMPLES

Examples of the present invention will be explained in detail below, but these examples are merely for the purpose of suitably explaining the present invention, and the present invention is not limited in any way to these examples.

Example

An elastic member of the type shown in FIG. 2 was produced by punching and bending a pure nickel flat sheet having a thickness of 0.2 mm. The first support parts, the second support part, and the first and second flat spring-like bodies of the elastic member produced thereby are explained in detail below.

Elastic Member

Bonding part: 9 mm

First support part: 12 mm

Second support part: 47 mm

Number of flat spring-like bodies per electrode unit surface area (total number of first flat spring-like bodies and second flat spring-like bodies): $9600/m^2$ First Flat Spring-Like Bodies Length from starting point (reference sign 41A in FIG. 2) to bending point (reference sign 41B in FIG. 2): 10.5 mm Length of parallel portion (portion parallel to second support part; reference sign 51 in FIG. 3): 4.5 mm Length of inclined portion (portion inclined relative to second support part; reference sign 52 in FIG. 3): 13.5 mm Inclination angle of inclined portion: 40° relative to second support part Curvature radius in longitudinal direction cross-section of distal end: 2 mm Curvature radius in cross-section of direction orthogonal to longitudinal direction of distal end: 1.5 mm Second Flat Spring-Like Bodies Length of parallel portion (portion parallel to second support part; reference sign 51 in FIG. 3): 4.5 mm Length of inclined portion (portion inclined relative to second support part; reference sign 52 in FIG. 3): 13.5 mm Inclination angle of inclined portion: 40° relative to second support part Curvature radius in longitudinal direction cross-section of distal end: 2 mm Curvature radius in cross-section of direction orthogonal to longitudinal direction of distal end: 1.5 mm

Comparative Example

An elastic member of a comparative example was produced by punching and bending a pure nickel flat sheet having a thickness of 0.2 mm. The elastic member of the comparative example has a shape corresponding to FIG. 7 of Patent Literature 1. Therein, a single spring row in which flat spring-like bodies corresponding to the second flat spring-like bodies are arranged alternately in two rows opposing each other is formed on the spring retaining part. The distal ends have the shape shown in FIG. 5, and the distal ends are not machined into an arc shape in the longitudinal direction cross-section or the cross-section in the direction orthogonal to the longitudinal direction. The dimensions, etc. of the flat spring-like bodies corresponding to the second flat spring-like bodies are as follows.

Elastic Member

Bonding part: 9 mm

First support part: 12 mm

Second support part: 47 mm

Number of flat spring-like bodies per electrode unit surface area: 3200/$m^2$

Spring-Like Bodies

Length of parallel portion (portion parallel to second support part): 7 mm

Length of inclined portion (portion inclined relative to support part): 28.5 mm

Inclination angle of inclined portion: 20° relative to second support part

Curvature radius in longitudinal direction cross-section of distal end: 2 mm

The amount of compression and the contact surface pressure of the elastic member were measured using the elastic members that were produced in the example and the comparative example. FIG. 6 is a graph illustrating the relationship between the amount of compression of the flat spring-like bodies and the contact surface pressure in the example and the comparative example. In FIG. 6, the contact surface pressure on the vertical axis is represented using the value at 4 mm of the amount of compression of the flat spring-like bodies of the example as a reference. FIG. 7 is a graph illustrating the relationship between the amount of compression of the flat spring-like bodies and the load per one flat spring-like body in the example and the comparative example. In FIG. 7, the load on the vertical axis is represented using the value at 4 mm of the amount of compression of the flat spring-like bodies of the example as a reference. The load per one flat spring-like body is a value obtained by dividing the contact surface pressure by the total number of flat spring-like bodies. In the case of the example, the load is the average of the first flat spring-like bodies and the second flat spring-like bodies.

As shown in FIG. 6, the elastic member of the example exhibited a higher contact surface pressure than the elastic member of the comparative example. Further, referring to FIG. 7, it can be understood that the load per one flat spring-like body is smaller in the example. From these results, it can be said that the elastic member of the example can better suppress damage to the membrane and electrode.

The voltage between the electrodes was measured upon operating electrolytic cells in which the elastic members of the example and the comparative example were installed within the cathode chamber. This experiment was conducted using a plain weave mesh (material: pure nickel; catalyst: platinum group metal-containing layer) as the cathode and with a current density during operation of 6.0 kA/$m^2$. In the results, the voltage between the electrodes was 2.9 V when using the elastic member of the example, whereas the voltage between the electrodes was higher at 2.96 V when using the elastic member of the comparative example. It can be said that this result was due to the greater number of spring-like bodies in the elastic member of the example compared to the elastic member of the comparative example, which allowed the electrodes to be closely fitted to the membrane more uniformly.

REFERENCE SIGNS LIST

1 Electrolytic cell unit
2 Anode
3 Anode chamber
4 Cathode
5 Cathode chamber
6 Electrolytic partition wall
**6*a*** Anode partition wall
**6*b*** Cathode partition wall
7 Anode retaining member
8 Membrane
10 Elastic member
20 Bonding part
30 Spring retaining part
31 First support part
32 Second support part
40, 140 Spring row
41, 141 First flat spring-like bodies
42, 142 Second flat spring-like bodies
43 Spring group

The invention claimed is:

1. An electrolytic cell comprising:

an anode chamber for receiving an anode;

a cathode chamber for receiving a cathode;

an electrolytic partition wall that partitions the anode chamber and the cathode chamber; and an elastic member attached to the electrolytic partition wall within at least one of the anode chamber or the cathode chamber, wherein the elastic member has a spring retaining part that includes a bonding part that is bonded to the electrolytic partition wall, a pair of first support parts that extend from the bonding part in an opposite direction of the electrolytic partition wall and that are parallel to each other, a second support part that connects ends of the pair of first support parts, and two spring rows extending in a direction parallel to a parallel arrangement direction of the pair of first support parts, wherein each of the two spring rows comprises a combination of a plurality of first flat spring-like bodies, which originate from the pair of first support parts and extend toward the opposite direction of the electrolytic partition wall, and a plurality of second flat spring-like bodies, which originate from the second support part and extend toward the opposite direction of the electrolytic partition wall.

2. The electrolytic cell of claim 1 wherein each of the plurality of first flat spring-like bodies is bent towards an opposing one of the pair of first support parts at a position that is the same distance as that from the bonding part to a connecting part of the pair of first support parts and the second support part.

3. The electrolytic cell of claim 1 wherein each of the plurality of first flat spring-like bodies first extends parallel to a direction in which the pair of first support parts extend in the opposite direction of the electrolytic partition wall to a position that is the same distance as that from the bonding part to a connecting part of the pair of first support parts and the second support part, then is bent toward an opposing one of the pair of first support parts at a position that is the same distance as that from the bonding part to the connecting part.

4. The electrolytic cell of claim 1 wherein each of the two spring rows includes a spring unit in which the plurality of first flat spring-like bodies and the plurality of second flat spring-like bodies are disposed alternately.

5. The electrolytic cell of claim 1 wherein distal ends of the plurality of first flat spring-like bodies and distal ends of the plurality of second flat spring-like bodies form a bent shape that is convex toward the opposite direction of the electrolytic partition wall in a longitudinal direction cross-section view.

6. The electrolytic cell of claim 1 wherein distal ends of the plurality of first flat spring-like bodies and distal ends of the plurality of second flat spring-like bodies form a bent shape that is convex towards the opposite direction of the electrolytic partition wall in a cross-section view of a plane that is orthogonal to a longitudinal direction.

7. An electrolytic cell comprising:

an anode chamber for receiving an anode;

a cathode chamber for receiving a cathode;

an electrolytic partition wall that partitions the anode chamber and the cathode chamber; and an elastic member attached to the electrolytic partition wall within at least one of the anode chamber or the cathode chamber, wherein the elastic member has a spring retaining part and bonding parts, wherein the bonding parts are bonded to the electrolytic partition wall, wherein the spring retaining part includes a pair of first support parts that extend from the bonding parts away from the electrolytic partition wall, a second support part that connects the pair of first support parts, and two spring rows, each of which two spring rows comprises first flat spring-like bodies disposed alternately with second flat spring-like bodies.

8. The electrolytic cell of claim 7 wherein the first flat spring-like bodies are orthogonal to the second flat spring-like bodies.

9. The electrolytic cell of claim 7 wherein the first flat spring-like bodies extend from the pair of first support parts.

10. The electrolytic cell of claim 7 wherein the second flat spring-like bodies extend from the second support part.

11. The electrolytic cell of claim 7 wherein the second support part is orthogonal to the pair of first support parts.

12. The electrolytic cell of claim 7 wherein pair of first support parts extend away from the electrolytic partition wall.

13. The electrolytic cell of claim 7 wherein the first and second flat spring-like bodies are inclined so as to extend away from both the second support part and the electrolytic partition wall.

14. The electrolytic cell of claim 7 wherein each of the pair of first support parts includes an orthogonal bend, wherein a first distance between the bonding parts and the orthogonal bends is equal to a second distance between the orthogonal bends and a point at which the pair of first support parts connect with the second support part.

15. The electrolytic cell of claim 7 wherein the second flat spring-like bodies extend toward the cathode chamber.

16. The electrolytic cell of claim 7 wherein distal ends of the first and second flat spring-like bodies are bent towards the electrolytic partition wall.

17. The electrolytic cell of claim 7 wherein the first and second flat spring-like bodies are curved such that edges extending along lengths of the first and second flat spring-like bodies are bent towards the electrolytic partition wall.

* * * * *